US012630268B1

(12) United States Patent
Thienphrapa

(10) Patent No.: US 12,630,268 B1
(45) Date of Patent: May 19, 2026

(54) AIRBOAT WITH CURVED HULL AND ADJUSTABLE STABILITY FLOATS

(71) Applicant: John Suratana Thienphrapa, Los Angeles, CA (US)

(72) Inventor: John Suratana Thienphrapa, Los Angeles, CA (US)

( * ) Notice: Subject to any disclaimer, the term of this patent is extended or adjusted under 35 U.S.C. 154(b) by 0 days.

(21) Appl. No.: 19/392,991

(22) Filed: Nov. 18, 2025

Related U.S. Application Data

(60) Provisional application No. 63/834,816, filed on Apr. 28, 2025.

(51) Int. Cl.

| | |
|---|---|
| ***B63B 39/02*** | (2006.01) |
| ***B63H 7/02*** | (2006.01) |
| ***B63H 25/02*** | (2006.01) |
| ***B63H 25/42*** | (2006.01) |

(52) U.S. Cl.
CPC ..... *B63B 39/02* (2013.01); *B63H 7/02* (2013.01); *B63H 25/02* (2013.01); *B63H 25/42* (2013.01); *B63B 2241/04* (2013.01); *B63H 2025/022* (2013.01)

(58) Field of Classification Search
CPC ..... B63B 39/02; B63B 2241/04; B63H 7/02; B63H 25/02; B63H 25/42
See application file for complete search history.

(56) References Cited

U.S. PATENT DOCUMENTS

| | | | | |
|---|---|---|---|---|
| 10,967,947 | B1 * | 4/2021 | McIntyre, II | B63H 21/30 |
| 2024/0151528 | A1 * | 5/2024 | Curless | B63H 7/02 |

FOREIGN PATENT DOCUMENTS

| | | | | |
|---|---|---|---|---|
| AU | 5721499 A | * | 3/2000 | B63B 1/18 |
| CA | 2071527 A1 | * | 6/1991 | B63B 1/248 |
| WO | WO-0012380 A1 | * | 3/2000 | B63B 1/18 |

* cited by examiner

*Primary Examiner* — S. Joseph Morano
*Assistant Examiner* — Jovon E Hayes
(74) *Attorney, Agent, or Firm* — QuickPatents; Kevin Prince

(57) ABSTRACT

An airboat for traversing a body of water comprises a hull having a curved portion that extends from a bow to a step, and from the step to a stern. The step extends laterally from a port side to a starboard side and is positioned between 30% and 35% of the hull length from the bow. Adjustable floats extend laterally outward from the hull and are rotatable to allow different engagement with the water. A motor is mounted on an axle that allows the motor to turn to control yaw of the airboat. The adjustable floats may have curved bottom surfaces and comprise a semicircle of lessening radius from aft to forward for variable water engagement. The airboat may include a passenger compartment with a steering wheel operatively connected to control the motor. The hull has a substantially planar bottom surface between the step and stern.

12 Claims, 5 Drawing Sheets

AIRBOAT WITH CURVED HULL AND ADJUSTABLE STABILITY FLOATS

CROSS REFERENCE TO RELATED APPLICATIONS

This application claims the benefit of U.S. Provisional Patent Application 63/834,816, filed on Apr. 28, 2025, and incorporated herein by reference.

STATEMENT REGARDING FEDERALLY SPONSORED RESEARCH AND DEVELOPMENT

Not Applicable.

FIELD OF THE INVENTION

This invention relates to airboats, and more particularly to an improved hull design for airboats.

BACKGROUND

Airboats are well-known for traveling on shallow water because of their unique flat-bottom design and propulsion system. Unlike traditional boats that use submerged propellers, airboats are powered by large fans mounted above the waterline. This allows airboats to glide smoothly over very shallow water areas, including marshes, swamps, and wetlands, where submerged engines would get damaged or stuck. The flat hull of regular airboats distributes weight evenly, preventing the boat from sinking into soft or muddy bottoms.

Additionally, airboats are highly maneuverable and can operate in areas with dense vegetation or floating debris, which would hinder other types of boats. Their ability to skim across the surface of the water—and even over short stretches of land—makes them especially useful in environments where traditional boats are impractical. These features make airboats a popular choice for rescue operations, eco-tours, and hunting or fishing in shallow or inaccessible waters.

However, the flat-hull design that provides these advantages also creates significant drawbacks. The completely flat bottom surface generates substantial drag when moving through water, which reduces speed and fuel efficiency. Additionally, traditional airboats often lack adequate stability control systems, making them difficult to handle in varying water conditions. The steering systems of conventional airboats typically rely on rudders or vertical stabilizers, which can be cumbersome and less responsive than desired.

Therefore, there is a need for an airboat design that reduces drag through improved hull geometry while maintaining the shallow-water capabilities of traditional flat-hull designs. Such a needed solution can also be applied to seaplane hulls and the floats of floatplanes. Further, such an invention would ideally incorporate adjustable stability features and more responsive steering control to enhance maneuverability and safety. The present invention accomplishes these objectives.

SUMMARY OF THE INVENTION

The present invention is an airboat for traversing a body of water, comprising a hull having a curved portion that extends from a bow to a step, and from the step to a stern.

The step extends laterally from a port side to a starboard side, with the step positioned a distance from the bow towards the stem of between 30% and 35% of a length of the hull. The airboat includes adjustable floats extending laterally outward from the hull, with the adjustable floats being rotatable to allow different engagement of the floats with the water. A motor is mounted on an axle that allows the motor to turn to control yaw of the airboat.

The motor may be electric or gas-powered. The adjustable floats may each have a curved bottom surface and are each mounted on an axle that rotates to cause the floats to engage the water surface differently at different angles. In a preferred embodiment, the floats comprise a semicircle of lessening radius from aft to forward, such that when the forward portion of the float is positioned above a water surface the forward portion is spaced above the water without contact, and when the aft portion of the float is positioned above a water surface the aft portion contacts or extends partially below a water surface.

The airboat may further comprise a passenger compartment proximate the bow of the curved hull. The passenger compartment may include a steering wheel operatively connected to control the motor and a steering axle operatively connected to transmit steering input to the motor through a chain and sprocket system. The distance from the bow to the step is preferably approximately 33% of the hull length. The hull has a substantially planar bottom surface between the step and the stern.

The present invention addresses the drawbacks of the prior art by providing an airboat design that significantly reduces drag through an improved hull geometry featuring a curved portion from bow to step and a substantially planar bottom surface from step to stern, while maintaining the shallow-water capabilities of traditional flat-hull designs. The invention incorporates adjustable floats that provide enhanced stability control through rotatable engagement with the water surface, allowing operators to adapt to varying water conditions. Additionally, the motor-on-axle steering system provides more responsive yaw control compared to conventional rudder-based systems, enhancing maneuverability and safety. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. When the words "substantially" or "about" are used, if a quantitative measurement is necessary, within 95% of "complete" or "exact" should be considered the meaning. The term "the invention" or "the present invention" should always be construed as "an embodiment of the invention."

Figure 1:
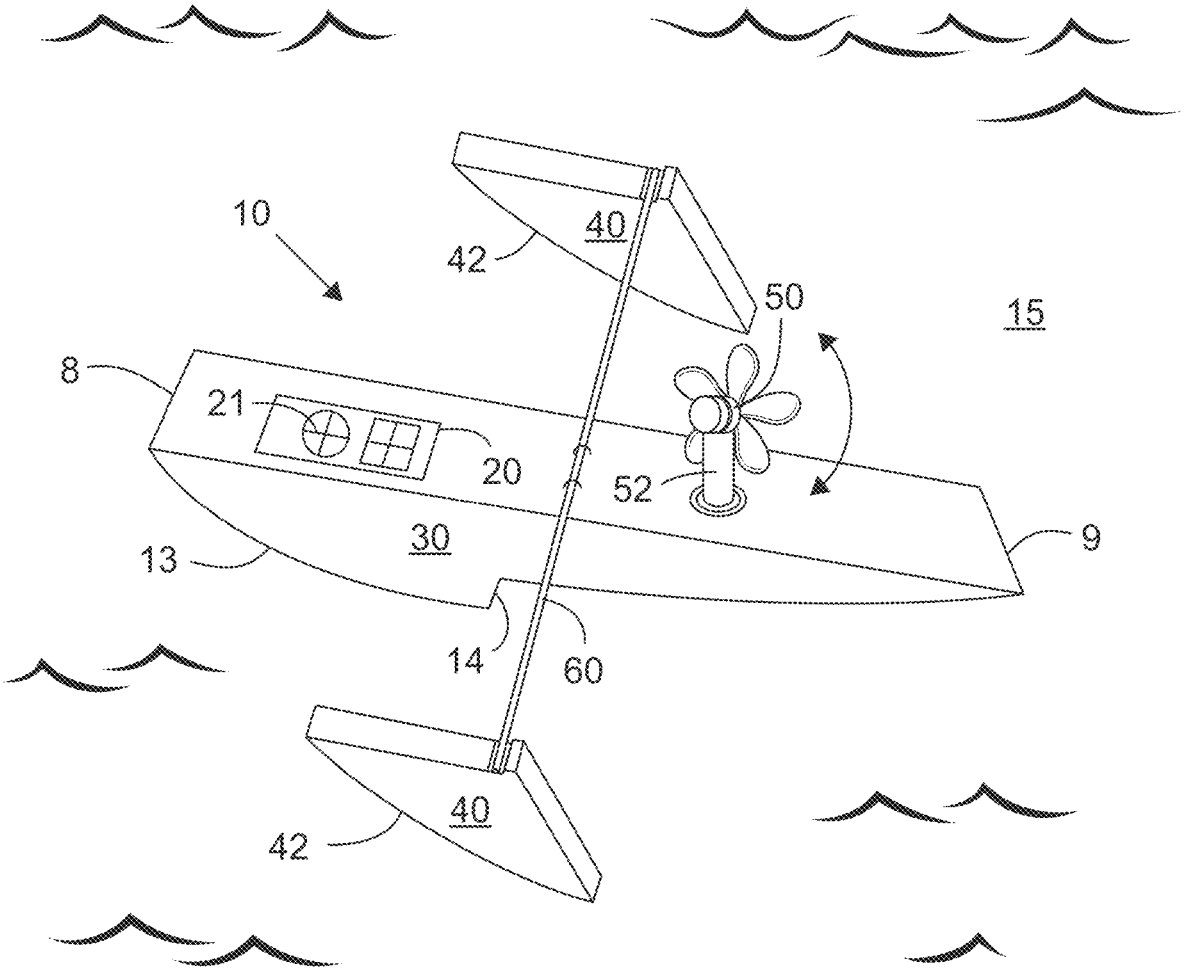
FIG. 1 is a perspective diagram of the preferred embodiment of the present curved and step hull airboat with adjustable floats.
Figure 2:
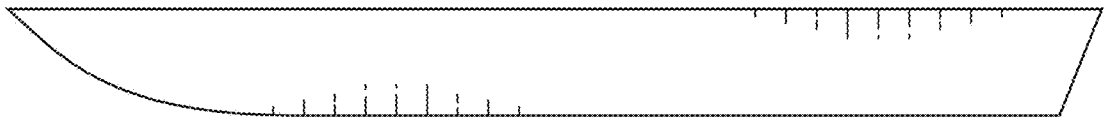
FIG. 2 is a side elevational view, of the traditional flat hull, of a prior art airboat.

FIG. 1 illustrates an airboat 10 for traversing a body of water 15, comprising a hull 30 having a curved portion 13 that extends from a bow 8 to a step 14, and from the step 14 to a stern 9. FIG. 2 shows a traditional flat-hull airboat of the prior art, which creates significant drag when moving through water 15 due to its completely flat bottom surface. In contrast, the present invention provides improved hydrodynamic performance through its curved and stepped hull design. The step 14 extends laterally from a port side 16 to a starboard side 17, with the step 14 positioned a distance D from the bow 8 towards the stern 9 of between 30% and 35% of a length L of the hull 30. Such a hull 30 may be constructed from wood, metal, fiberglass, carbon fiber, aluminum, or the like. The airboat 10 further includes adjustable floats 40 extending laterally outward from the hull 30, with such adjustable floats 40 being rotatable to allow different engagement of the floats 40 with the water 15. Such adjustable floats 40 are preferably made of fiberglass, foam, plastic, inflatable materials, or the like. A motor 50 is mounted on an axle 52 that allows the motor 50 to turn to control yaw of the airboat 10. Such a motor 50 may be constructed with components of metal, plastic, composite materials, or the like.

The motor 50 is preferably electric, providing quiet operation and environmental benefits. Such an electric motor 50 may include brushless DC motors, AC motors, or the like. Alternatively, the motor 50 may be gas-powered for extended range applications. Such a gas-powered motor 50 is preferably a gasoline engine, diesel engine, or the like.

As depicted in FIG. 1, the adjustable floats 40 preferably each have a curved bottom surface 42. Such a curved bottom surface 42 may be formed from molded fiberglass, shaped foam, curved plastic, or the like.

Figure 6:
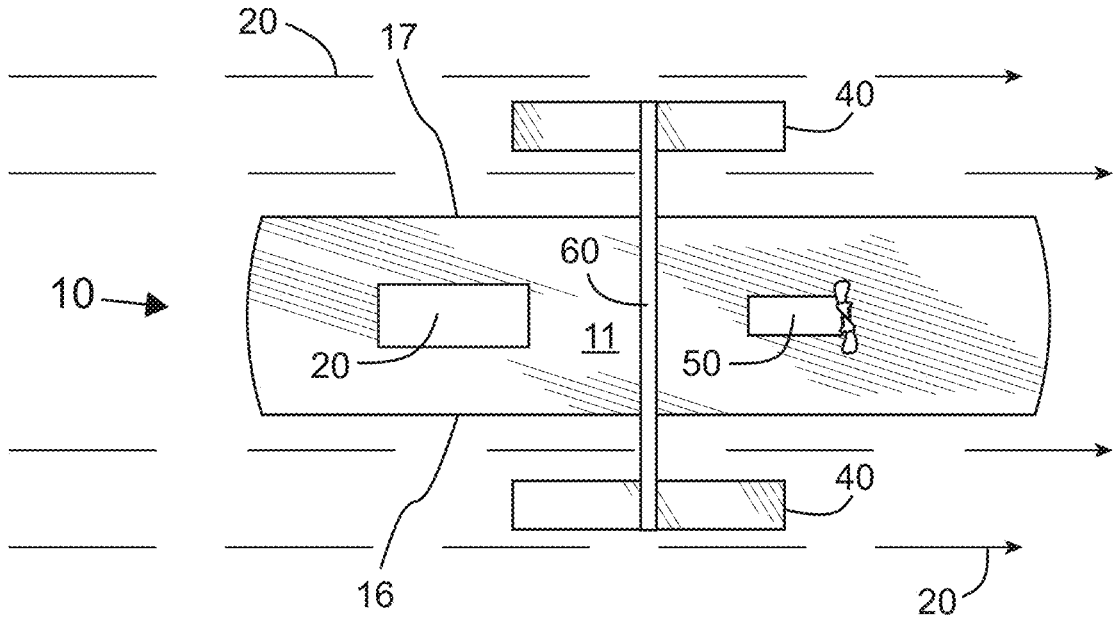
FIG. 6 is a top plan view of the present curved and step hull airboat with adjustable floats, on simulated water.
Figure 7:
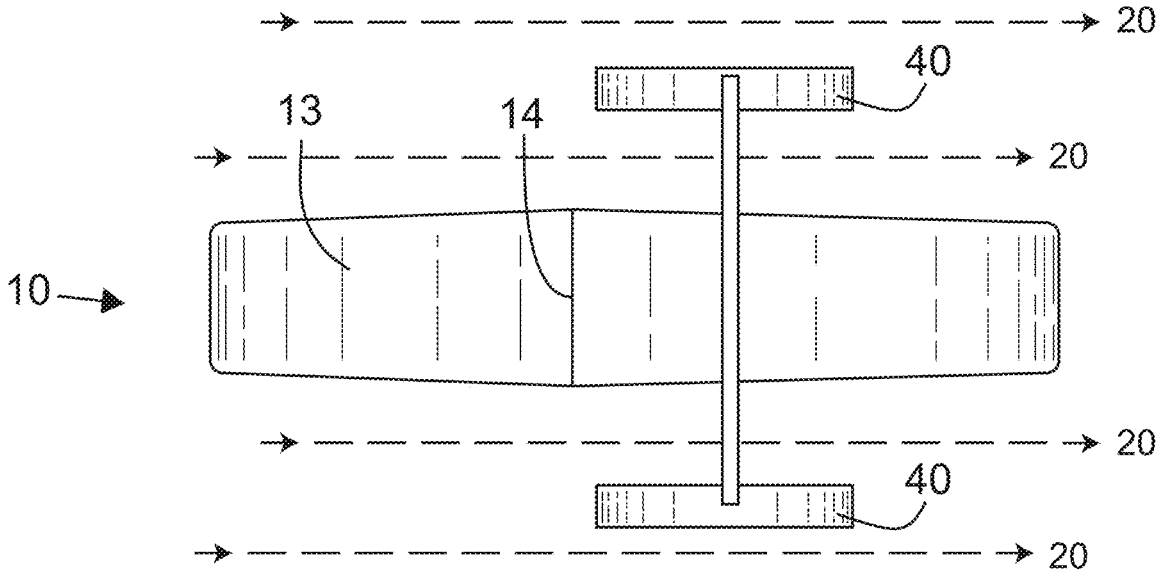
FIG. 7 is a bottom plan view of the present curved and step hull airboat with adjustable floats.

The adjustable floats 40 are preferably each mounted on an axle 60 that rotates to cause the floats 40 to engage the water surface differently at different angles, as shown in FIGS. 1, 6 and 7. Such an axle 60 may be constructed from steel, aluminum, stainless steel, or the like.

In a preferred embodiment shown in FIG. 1, the floats 40 comprise a semicircle of lessening radius from aft to forward, such that when the forward portion of the float 40 is positioned above a water surface 15 the forward portion is spaced above the water 15 without contact, and when the aft portion of the float 40 is positioned above a water surface 15 the aft portion contacts or extends partially below a water surface 15. Such a semicircular configuration provides optimal stability control across varying water conditions.

Figure 8:
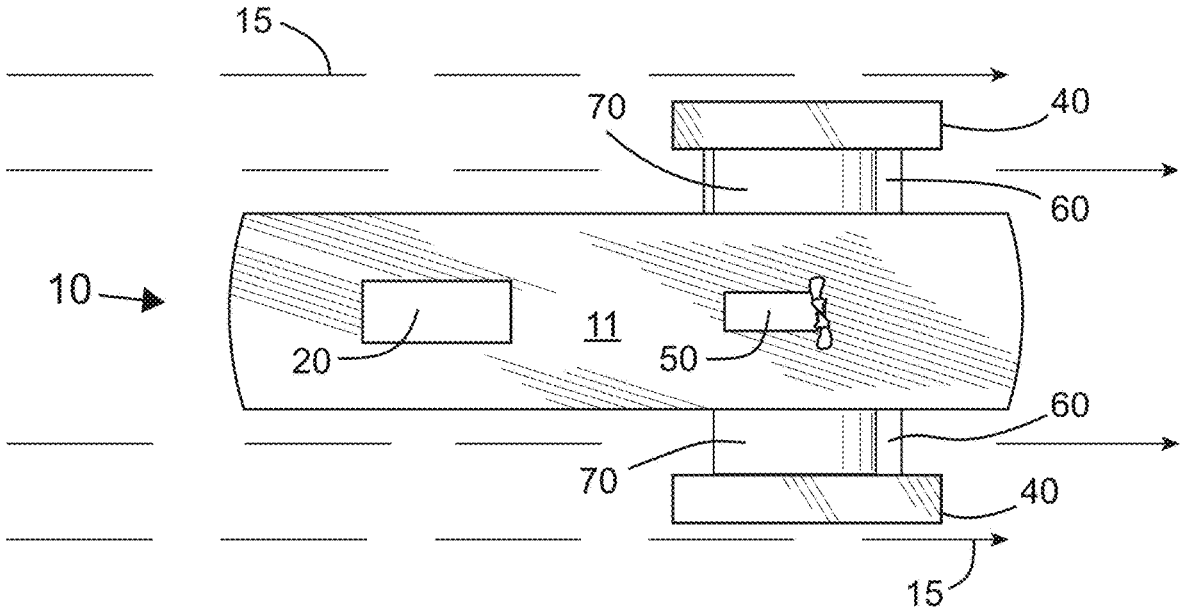
FIG. 8 is a top plan view of an alternate embodiment of the invention having wings.

The airboat 10 may further comprise a passenger compartment 20, wherein such a passenger compartment 20 is preferably proximate the bow 8 of the curved hull 30, as illustrated in FIGS. 1 and 8. Such a passenger compartment 20 may be constructed from fiberglass, aluminum, steel, composite materials, or the like.

Figure 5:
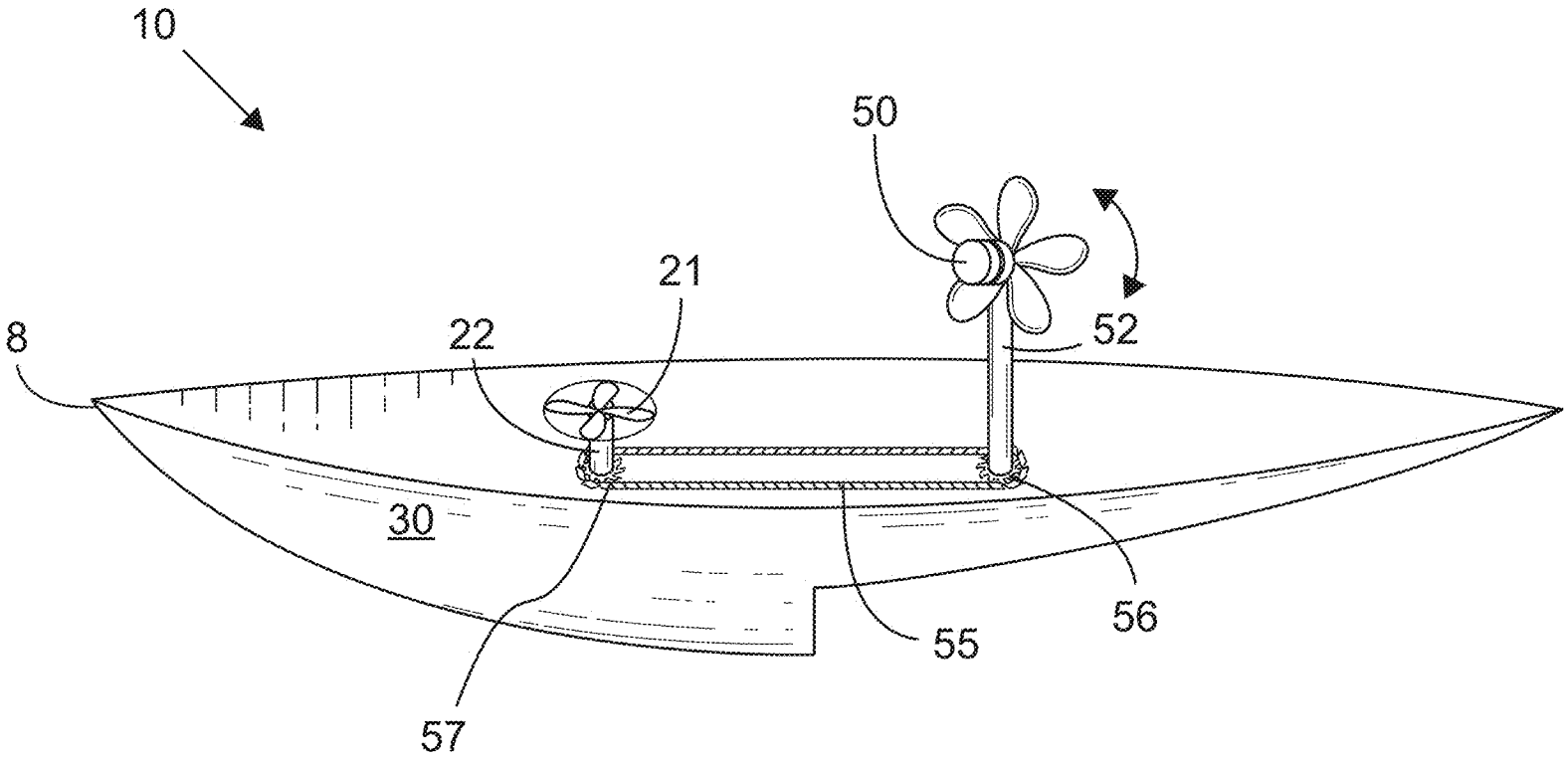
FIG. 5 is a top perspective view of the preferred embodiment, showing the steering mechanism with steering wheel, steering axle, chain, and sprockets, with the adjustable floats 40 omitted for clarity of illustration.

When included, the passenger compartment 20 preferably comprises a steering wheel 21, wherein such a steering wheel 21 is operatively connected to control the motor 50, and a steering axle 22, wherein such a steering axle 22 is operatively connected to transmit steering input to the motor 50, as shown in FIG. 5. Such a steering wheel 21 may be made from plastic, metal, wood, composite materials, or the like.

As depicted in FIG. 5, the steering axle 22 preferably comprises a sprocket 57, wherein such a sprocket 57 is mechanically connected to a chain 55, and the axle 52 that the motor 50 is mounted on further comprises a sprocket 56, wherein such a sprocket 56 is also mechanically connected to the chain 55, thereby enabling steering control of the motor 50 via the steering wheel 21. Such sprockets 56, 57 may be constructed from steel, aluminum, plastic, or the like, and such a chain 55 is preferably made from steel, stainless steel, or the like.

In a preferred embodiment, the distance D is approximately 33% of the length L of the hull 30, providing optimal hydrodynamic performance.

Figure 3:
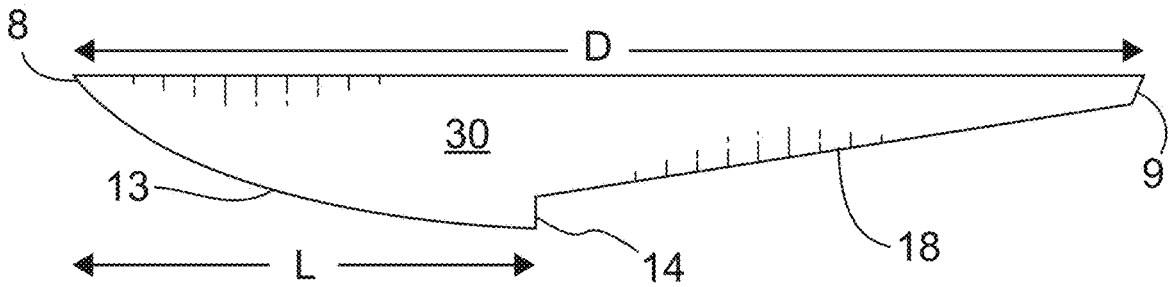
FIG. 3 is a side elevational view of the present curved and step hull airboat.
Figure 4:
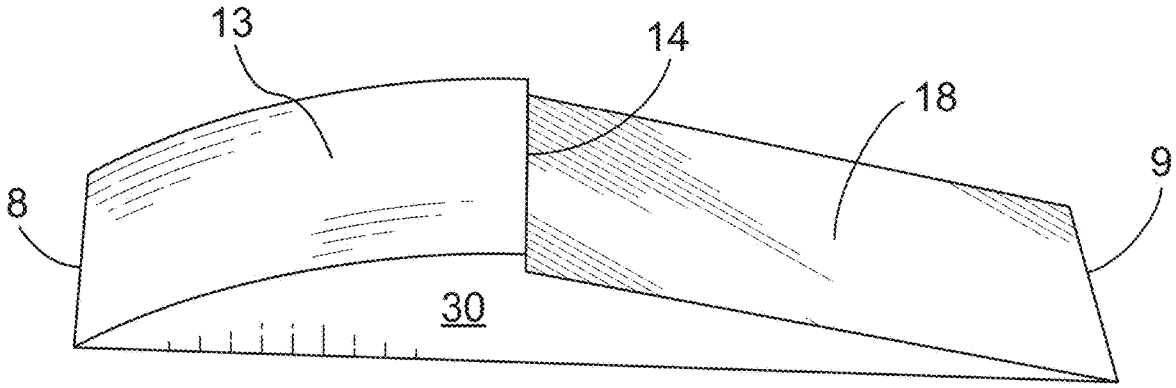
FIG. 4 is a bottom perspective view of the present curved and step hull airboat.

As shown in FIGS. 3 and 4, the hull 30 preferably has a substantially planar bottom surface between the step 14 and the stern 9, creating a planing surface for efficient water travel. Such a planar bottom surface may be constructed from the same materials as the hull 30.

As illustrated in FIG. 8, the airboat 10 may further include wings 70 positioned between the adjustable floats 40 and the hull 30 to provide additional stability and lift characteristics during operation.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An airboat (10) for traversing a body of water (15), comprising:

a hull (30) having a curved portion (13) that extends from a bow (8) to a step (14), and from the step (14) to a stern (9), the step (14) extending laterally from a port side (16) to a starboard side (17), the step (14) positioned a distance D from the bow (8) towards the stern (9) of between 30% and 35% of a length L of the hull (30);

adjustable floats (40) extending laterally outward from the hull (30), the adjustable floats (40) being rotatable to allow different engagement of the floats (40) with the water (15); and a motor (50) mounted on an axle (52) that allows the motor (50) to turn to control yaw of the airboat (10).

2. The airboat (10) of claim 1, wherein the motor (50) is electric.

3. The airboat (10) of claim 1, wherein the motor (50) is gas-powered.

4. The airboat (10) of claim 1, wherein the adjustable floats (40) each have a curved bottom surface (42).

5. The airboat (10) of claim 1, wherein the adjustable floats (40) are each mounted on an axle (60) that rotates to cause the floats (40) to engage the water surface differently at different angles.

6. The airboat (10) of claim 5, wherein the floats (40) comprise a semicircle of lessening radius from aft to forward, such that when the forward portion of the float (40) is positioned above a water surface (15) the forward portion is spaced above the water (15) without contact, and when the aft portion of the float (40) is positioned above a water surface (15) the aft portion contacts or extends partially below a water surface (15).

7. The airboat (10) of claim 1, wherein the airboat (10) further comprises:

a passenger compartment (20), wherein the passenger compartment (20) is proximate the bow (8) of the curved hull (30).

8. The airboat (10) of claim 7, wherein the passenger compartment (20) comprises:

a steering wheel (21), wherein the steering wheel (21) is operatively connected to control the motor (50); and, a steering axle (22), wherein the steering axle (22) is operatively connected to transmit steering input to the motor (50).

9. The airboat (10) of claim 8, wherein the steering axle (22) comprises:

a sprocket (57), wherein the sprocket (57) is mechanically connected to a chain (55);

and further wherein, the axle (52) that the motor (50) is mounted on, further comprises: a sprocket (56), wherein the sprocket (56) is also mechanically connected to the chain (55), thereby enabling steering control of the motor (50) via the steering wheel (21).

10. The airboat (10) of claim 1 wherein the distance D is approximately 33%.

11. The airboat (10) of claim 1 wherein the hull (30) has a substantially planar bottom surface between the step (14) and the stern (9).

12. An improved hull design that allows an airboat, seaplane, or floatplane to travel across a body of water with reduced drag, enabling faster speeds and reduced energy consumption, comprising:

a hull (30) having a curved portion (13) that extends from a bow (8) to a step (14), and from the step (14) to a stern (9), the step (14) extending laterally from a port side (16) to a starboard side (17), the step (14) positioned a distance D from the bow (8) towards the stern (9) of between 30% and 35% of a length L of the hull (30);

adjustable floats (40) extending laterally outward from the hull (30), the adjustable floats (40) being rotatable to allow different engagement of the floats (40) with the water (15); and a motor (50) mounted on an axle (52) that allows the motor (50) to turn to control yaw of the airboat (10).

* * * * *